US005950930A

United States Patent [19]

Potz et al.

[11] Patent Number: 5,950,930

[45] Date of Patent: Sep. 14, 1999

[54] FUEL INJECTION VALVE FOR INTERNAL COMBUSTION ENGINES

[75] Inventors: Detlev Potz, Stuttgart; Uwe Gordon, Markgroeningen, both of Germany

[73] Assignee: Robert Bosch GmbH, Stuttgart, Germany

[21] Appl. No.: 08/965,888

[22] Filed: Nov. 7, 1997

[30] Foreign Application Priority Data

Nov. 7, 1996 [DE] Germany ..... 196 45 900

[51] Int. Cl.[6] ..... F02M 45/00

[52] U.S. Cl. ..... 239/533.4

[58] Field of Search ..... 239/533.3–533.12, 239/533.4, 585.1–585.5

[56] References Cited

U.S. PATENT DOCUMENTS

| | | | |
|---|---|---|---|
| 3,612,407 | 10/1971 | Itano | 234/533.4 |
| 4,216,912 | 8/1980 | Kopse | 239/533.4 |
| 4,238,075 | 12/1980 | Bauder | 239/533.9 X |
| 4,549,696 | 10/1985 | Gaskell | 239/533.4 X |
| 4,909,444 | 3/1990 | Sczomak | 239/533.4 X |

FOREIGN PATENT DOCUMENTS

| | | | |
|---|---|---|---|
| 43 40 883 A1 | 6/1995 | Germany . | |
| 351798 | 3/1961 | Switzerland | 239/533.4 |

*Primary Examiner*—Kevin Weldon

*Attorney, Agent, or Firm*—Edwin E. Greigg; Ronald E. Griegg

[57] ABSTRACT

A fuel injection valve for internal combustion engines, having a valve body member axially displaceable in a bore of the valve body. The valve member has a sealing face with which the sealing face cooperates with a valve seat on the valve body. The valve body has at least one injection opening, which can be uncovered in a course of a valve member opening stroke motion only after a certain idle stroke has been excited and the valve sealing face has lifted from the valve seat. The injection opening is provided in the wall of the valve body and an inlet opening of the injection opening is closable by the valve member.

4 Claims, 2 Drawing Sheets

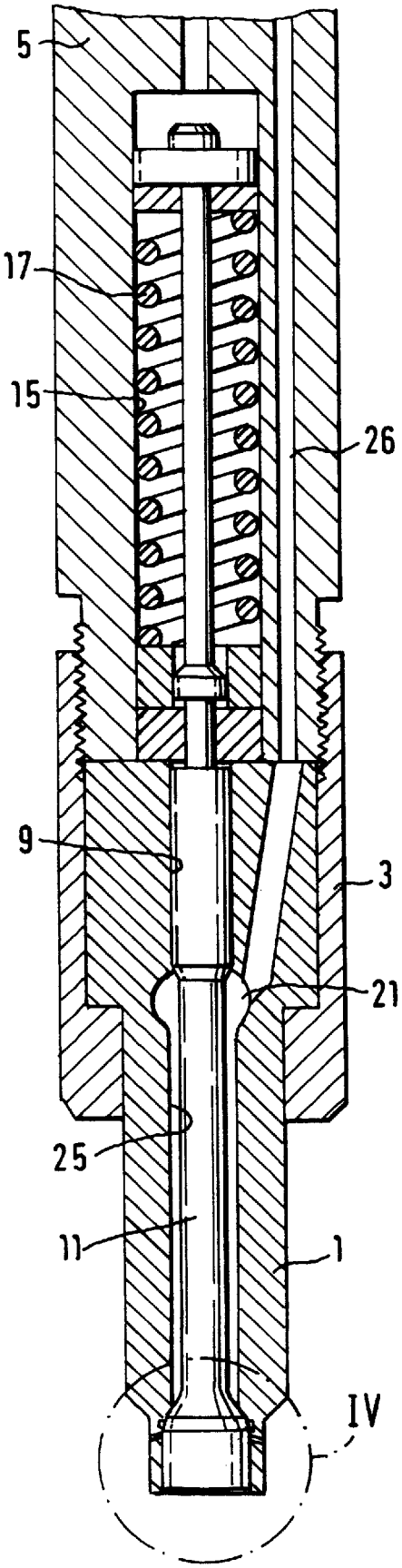
FIG. 3
FIG. 4
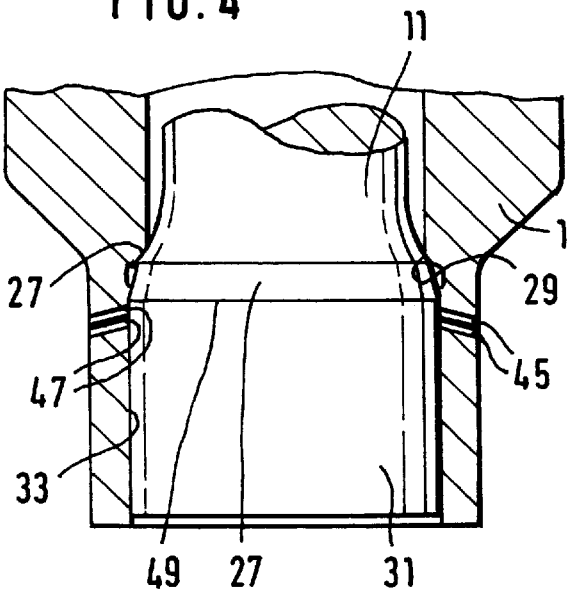

FUEL INJECTION VALVE FOR INTERNAL COMBUSTION ENGINES

BACKGROUND OF THE INVENTION

The invention is based on a fuel injection valve for internal combustion engines. In one such fuel injection valve for internal combustion engines, known from German Patent Disclosure DE 43 40 883 A1, a pistonlike valve member is guided axially displaceably in a bore of a valve body that protrudes with its free lower end into the combustion chamber of the engine to be supplied. The known valve member, on its lower end toward the combustion chamber, has a closing head, which protrudes from the bore of the bb and whose annular edge toward the valve body forms a conical valve sealing face that cooperates with a conical valve seat on the valve body. The valve member is guided sealingly, with its region opening at the closing head, in the bore of the valve body and in that region has injection openings, which communicate via bores in the valve member with a fuel-filled pressure chamber. The outlet openings of these injection openings, which are preferably disposed in two rows axially one above the other are closed by the wall of the bore of the valve body when the injection valve is closed. With the onset of the outward-oriented opening stroke motion of the valve member, the valve sealing face of the valve member first lifts away from the fixed valve seat, and after executing a certain idle stroke, the lower row of injection ports departs from its coincidence with the valve body, so that a first partial injection cross section is uncovered, by way of which the fuel is injected into the combustion chamber. If the opening pressure at the valve member rises further, then the opening stroke motion of the valve member is continued, and the second, upper row of injection ports or injection openings emergences from coincidence with the valve body, so that the entire injection cross section at the injection valve is now uncovered.

However, the known fuel injection valve with a controllable injection cross section has the disadvantage of being relatively large and complicated in structure, and hence it cannot be installed in existing injection systems without making major adaptations. Moreover, in the known injection valve, during the stroke motion of the valve member, the location of the injection openings and thus of the injection streams varies three-dimensionally, making it difficult to optimize them.

OBJECT AND SUMMARY OF THE INVENTION

The fuel injection valve according to the invention for internal combustion engines has the advantage over the prior art that despite having a controllable injection cross section, it is structurally simple in design, and because it has the same outside dimensions as conventional injection valves, it can easily be inserted into existing injection systems, or the receptacles therein. To that end, in the fuel injection valve of the invention, the injection openings are advantageously disposed in the valve body and are closed by the valve member at their inlet opening when the injection valve is closed.

To that end, on its end toward the combustion chamber, the valve member has a piston slide, which is guided sealingly in the valve body bore and with its jacket face covers the injection bores. The pairing of the piston slide and the bore wall forms a first seal at the injection valve, which is advantageously supplemented with a sealing seat that is formed between a conical valve sealing face on the valve member and a conical valve seat on the valve body and that is disposed upstream of the piston slide, in terms of the fuel flow direction. In this way, even at very high injection pressures, a high sealing action can be achieved; the sealing seat itself is disposed in the interior of the injection valve and is thus protected against being soiled or contaminated with combustion gases; hence the injection valve of the invention also has high functional reliability.

A plurality of rows of injection openings axially one above the other in the axial direction is provided, preferably two such rows, which are uncovered in succession by the piston slide after it executes a certain idle stroke. As an alternative to these two rows of injection ports, it is also possible to have more rows of injection ports and arbitrary constellations and arrangements of them. It is also possible in combination with known injection systems, such as two-spring holders, common rail systems, or other solenoid-controlled injection systems, to form the opening stroke motion of the valve member in a linear damped or multistage, preferably two-stage fashion by employing a graduated closing force; after passing through each opening stroke stage, the valve member is then in a position in which one row of injection ports has just been uncovered completely.

In addition to the stroke motion, the injection rate can advantageously be controlled via the number, design, disposition and combination of the injection cross sections. A throttle on the sealing seat, as is known for conventional seat hole nozzles no longer occurs in the shaping of the injection course. The narrowest cross section, during the entire course of injection, is always only the injection cross section at the injection openings, because as a result of a suitable design the throttle restriction at the seat is no longer operative when the injection cross section is uncovered.

Disposing the injection openings in the valve body has the advantage that their position is constant. Moreover, changes in the angle of the injection stream as a result of partially covered injection ports in the case of a slide located in an inner position have less of an impact as covering of the injection port outlet would have, so that the injection stream can be adjusted more precisely.

Because of the pressure impingement on the valve member, strength-increasing provisions on the valve member are unnecessary, even at very high injection pressures.

The injection valve may be provided alternatively with an inward-opening or an outward-opening valve member; in each case an annular edge on the piston slide of the valve member forms a control edge, whose overtaking of the injection openings controls the onset and end of injection.

As an alternative to the exemplary embodiment described, the outward-opening valve member may also have corresponding transverse and longitudinal grooves on the piston slide, by way of which the fuel flows out of the high-pressure conduit to the individual injection openings.

The invention will be better understood and further objects and advantages thereof will become more apparent from the ensuing detailed description of preferred embodiments taken in conjunction with the drawings.

BRIEF DESCRIPTION OF THE DRAWINGS

FIGS. 3 and 4 show a second exemplary embodiment, with a valve member lifting outward from the valve seat, in one complete sectional view and one enlarged detail of the piston slide on the valve member.

DESCRIPTION OF THE PREFERRED EMBODIMENTS

Figure 1:
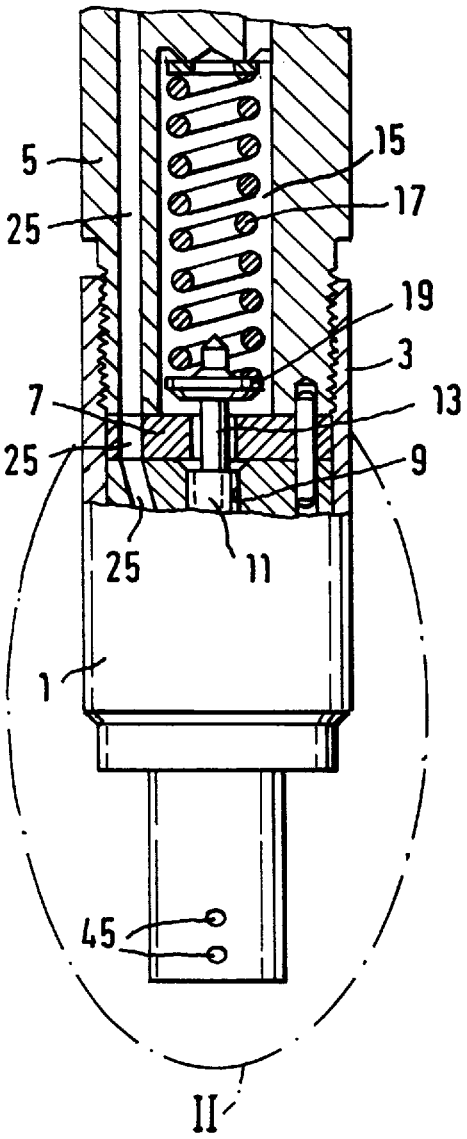
FIGS. 1 and 2 show a first exemplary embodiment, in which the valve member lifts inward away from the valve seat, in two sectional views.
Figure 2:
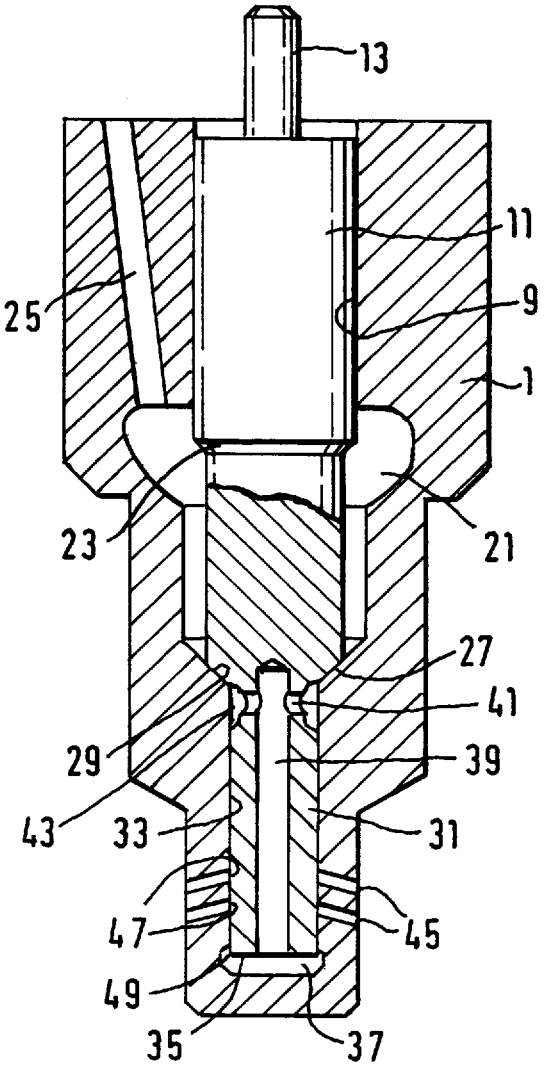

The first exemplary embodiment, shown in FIGS. 1 and 2, of the fuel injection valve of the invention has a valve body 1, which protrudes by its lower free end into a combustion chamber, not shown, of the engine to be supplied. On its upper end, remote from the combustion chamber, the valve body 1 is braced axially by means of a lock nut 3 against a valve holder body 5; a washer 7 machined to close tolerances is fastened between the valve body 1 and the valve holder body 5. The valve body 1 has an axial blind bore 9, which begins at its upper end face and in which a pistonlike valve member 11 is guided axially displaceably; one end of this valve member protrudes into the region toward the combustion chamber of the valve body 1, and its other end, remote from the combustion chamber, protrudes with a shaft portion 13 of reduced diameter through the washer 7 into a spring chamber 15 disposed in the valve holder body 5. A valve spring 17 is fastened in this spring chamber 15, being supported by its upper end, remote from the valve member 11, on a housing shoulder of the spring chamber 15 and on its other end via a spring plate 19 that engages the valve member 11. In the exemplary embodiment, only one valve spring 17 is shown, but as an alternative, two valve springs coming into action in succession (two-spring holder) are also possible.

The valve member 11 is guided by its upper end initially sealingly in the bore 9 of the valve body 1; in the region of a pressure chamber 21 (FIG. 2) formed by a widening of the bore 9, however, it has a pressure shoulder 23, by way of which the diameter of the valve member 11 decreases toward the combustion chamber, and at which the high fuel pressure engages the valve member 11 in the opening direction. The delivery of high fuel pressure to the pressure chamber 21 takes place via a pressure conduit 25, axially penetrating the injection valve, to which an injection line, not shown, that leads away from a fuel injection pump is connected.

In a middle portion, downstream of the pressure shoulder 23, the valve member has a conical cross-sectional constriction, which forms a valve sealing face 27 that cooperates with an opposed conical valve seat 29 on the valve body 1 that is formed at a diameter reduction of the bore 9. The valve member 11 is adjoined, downstream of the valve sealing face 27, by a cylindrical extension that forms a piston slide 31, which is guided sealingly in a portion 33 of the bore 9 adjoining the valve seat 29 and which with its lower free end face 35 defines a fuel chamber 37 in the closed end of the bore 9. This fuel chamber 37 communicates, via a longitudinal bore 39 beginning at the end face 35 and a transverse bore 41 that intersects the longitudinal bore, with an annular chamber 43 that is directly adjacent the valve seat face 29. In the lower end, toward the combustion chamber of the valve body 1, injection openings 45 are provided, which beginning at the portion 33 of the bore 9 discharge into the combustion chamber of the engine to be supplied; preferably two rows of injection openings 45 are provided, disposed axially one above the other. The inlet openings 47 of the injection openings 45 on the wall of the bore portion 33 are closed sealingly by the circumferential wall of the piston slide 31 when the valve member 11 is resting on the valve seat 29 (that is, when the injection valve is closed).

The annular edge formed at the transition from the end face 35 to the jacket face of the piston slide 31 forms a control edge 49 of the valve member 11, which when it overtakes the inlet openings 47 of the injection openings 45 initiates or terminates the injection event.

The fuel injection valve according to the invention functions as follows:

When the injection valve is closed as shown in FIG. 2, the valve member 11 is held sealingly by the valve spring 17 with its valve sealing face 27 against the valve seat 29; the injection openings 45 are covered by the piston slide portion 31 of the valve member 11. At the onset of the injection event, the fuel, which is at high pressure, flows via the pressure conduit 25 into the pressure chamber 21 and engages the valve member 11 in the opening direction via the pressure shoulder 23. When a certain injection pressure is reached, the opening force engaging the valve member 11 overcomes the closing force of the valve spring 17, and the valve member 11 lifts from the valve seat 29. Via the opened sealing seat, high fuel pressure now flows via the bores 41, 39 in the piston slide 31 into the fuel chamber 37; the fuel pressure engaging the end face 35 reinforces the inward-oriented opening stroke motion of the valve member 11. After a certain idle stroke has been executed, the control edge 49 overtakes the lower row of injection openings 45, whose uncovered cross section corresponds to a partial injection cross section, and by way of which fuel is now injected into the combustion chamber of the engine.

The fuel pressure remains briefly at a level such that the valve member 11 remains in this position, in which a first row of injection ports is uncovered, until the fuel pressure rises further and displaces the valve member 11 onward in such a way that the second, upper row of injection openings 45 is uncovered as well, so that now the fuel injection takes place via the entire injection cross section.

This graduated opening stroke motion of the valve member can alternatively also be shaped by other known injection systems, such as a two-spring holder, common rail or solenoid-controlled unit fuel injectors.

The end of injection is initiated by the termination of the high-pressure delivery by the injection pump; as a result, the pressure in the pressure chamber 21 drops below the necessary opening pressure again and the valve spring 17 pushes the valve member back until it contacts the valve seat 29. The sealing guidance of the piston slide 31 in the bore 9, in addition to the sealing seat between the valve sealing face 27 and the valve seat 29, produces a high sealing action, so that even at very high injection pressures of above 1200 bar, high functional reliability is assured.

The second exemplary embodiment, shown in FIGS. 3 and 4, of the fuel injection valve of the invention differs from the first exemplary embodiment essentially in the valve member opening stroke motion, which is oriented outward in the second exemplary embodiment. To that end, in the second exemplary embodiment, the valve member 11 on its lower end toward the combustion chamber has a diameter increase, forming the piston slide 31, with which it is sealingly guided in the lower portion 33 of the bore 9 in the valve body 1. The cross-sectional transition from the piston slide 33 to the valve member shaft forms a conical valve sealing face 27 on the valve member 11, which face cooperates with a valve seat face 29 of the valve body 1, which is formed at a conical widening of the diameter of the bore 9 toward the portion 33. The annular edge formed at the transition between the circumferential face of the piston slide 31 and the valve sealing face 27 forms a control edge 49, which when it overtakes the inlet openings 47 of the injection openings 45 controls the onset and end of the high-pressure injection. Analogously to the first exemplary embodiment, the injection openings 45 are disposed, axially one above the other, in the wall of the valve body 1 in the region of the portion 33 of the bore 9, and upon the outward-oriented valve member opening stroke motion they are uncovered in succession by the control edge 49, so that the fuel at high pressure can flow out of the pressure conduit 25 along the valve sealing face 27 to the inlet openings 47 and in a known manner pass to injection into the engine combustion chamber via the injection openings 45. In the second exemplary embodiment as well, the opening stroke motion of the valve member is two-staged, and each closing force stage of the restoring means is assigned a valve member opening stroke position at which one of the injection openings 45, disposed axially one above the other, at a time is just opened by the piston slide 31.

The foregoing relates to preferred exemplary embodiments of the invention, it being understood that other variants and embodiments thereof are possible within the spirit and scope of the invention, the latter being defined by the appended claims.

We claim:

1. A fuel injection valve for injecting fuel under pressure in an internal combustion engine, comprising a valve body (1), a bore (9) in said valve body, a valve member (11) axially displaceable in said bore (9) of said valve body (1), said valve member has a sealing face (27) which cooperates with a valve seat (29) on the valve body (1), said valve member includes an end toward a combustion chamber of said engine, which forms a piston slide (31) that is guided sealingly in said bore (9) of said valve body, said valve member is lifted outwardly from the valve seat (29) counter to a restoring force of a spring (17), a plurality of injection openings (45) are disposed axially one above the other in a wall of the valve body (1), said piston slide (31) covers and closes an inlet opening (47) to each of the injection openings (45) when the valve is closed and the injection inlet openings are uncovered in succession in a course of an opening stroke of the valve member (11) only after a certain idle stroke has been excited and said valve sealing face has lifted from the valve seat (29) depending upon a pressure force of the fuel injected.

2. A fuel injection valve in accordance with claim 1, in which said spring exerts an increasing closing force on the valve member (11) in the course of a complete opening stroke motion of the valve member (11) whereby said plurality of injection openings (45) are opened in succession.

3. A fuel injection valve in accordance with claim 1, in which the valve member (11), upstream of the piston slide (31), has a conical face, that forms the valve sealing face (27), said valve sealing face cooperates with a conical cross-section transitional face that forms the valve seat (29), of the bore (9) of the valve body (1).

4. A fuel injection valve in accordance with claim 3, in which said spring exerts an increasing closing force on the valve member (11) in the course of a complete opening stroke motion of the valve member (11).

* * * * *